United States Patent [19]

Henderson et al.

[11] Patent Number: 4,991,598

[45] Date of Patent: Feb. 12, 1991

[54] METHOD OF AND APPARATUS FOR AUTOMATICALLY ANALYZING THE DEGRADATION OF PROCESSED LEAF TOBACCO

[75] Inventors: Richard M. Henderson; Roger A. Foote, both of Winston-Salem; Henry H. Warren, Jr., Clemmons; D. Randall McHone, Winston-Salem, all of N.C.; David B. Coleman, Richmond, Va.

[73] Assignee: R. J. Reyolds Tobacco Company, Winston-Salem, N.C.

[21] Appl. No.: 395,876

[22] Filed: Aug. 18, 1989

[51] Int. Cl.[5] ..... A24C 5/00; A24C 5/92; A24C 5/14

[52] U.S. Cl. ..... 131/290; 131/312

[58] Field of Search ..... 131/290, 312

[56] References Cited

U.S. PATENT DOCUMENTS

| | | |
|---|---|---|
| 1,668,984 | 5/1928 | Simpson . |
| 1,791,291 | 2/1931 | Simpson . |
| 1,981,081 | 11/1934 | Simpson . |
| 2,047,713 | 7/1936 | Simpson . |
| 2,090,252 | 8/1937 | Damm . |
| 2,114,406 | 4/1938 | Simpson . |
| 2,149,368 | 3/1939 | Simpson . |
| 3,545,281 | 12/1968 | Johnston . |

FOREIGN PATENT DOCUMENTS

| | | |
|---|---|---|
| 0132846 | 2/1985 | European Pat. Off. . |
| 1632152 | 1/1971 | Fed. Rep. of Germany . |

OTHER PUBLICATIONS

Exhibit A-2 sheets of photographs of conventional Griffin & Co. apparatus.

Exhibit B-1 sheet of photographs of conventional Rotex, Inc. apparatus.

*Primary Examiner*—U. Millin

*Attorney, Agent, or Firm*—Grover M. Myers

[57] ABSTRACT

A method of and apparatus for automatically analyzing the degradation of processed leaf tobacco are disclosed. The apparatus comprises a conveyor system for diverting a sample of leaf tobacco from an operating tobacco processing line, supplying the tobacco to a degradation analyzer and returning the tobacco to the processing line after the degradation analysis has been performed. The degradation analyzer comprises a weigh conveyor for receiving the tobacco sample, weighing it to insure it is within prescribed limits and delivering it to a vibratory screen separator where the tobacco is separated into a plurality of fractions of different-sized tobacco particles. The separated fractions are collected in weigh buckets, electronically weighed and discharged to the conveyor system for return to the tobacco processing line. A microprocessor controls the operation of the apparatus and, based on the weights of the tobacco fractions, calculates the percentage by weight of each tobacco fraction to the total weight of all fractions. The distribution of the weight percentages is indicative of degradation of the leaf tobacco being processed.

49 Claims, 6 Drawing Sheets

METHOD OF AND APPARATUS FOR AUTOMATICALLY ANALYZING THE DEGRADATION OF PROCESSED LEAF TOBACCO

FIELD OF THE INVENTION

The present invention relates generally to techniques for analyzing the degradation of leaf tobacco that occurs during the processing thereof and more particularly to methods of and apparatus for automatically analyzing a sample of leaf tobacco diverted from an operating tobacco processing line to determine the weight distribution of various predetermined sizes of the tobacco leaf, including tobacco fines, in the sample.

DESCRIPTION OF THE PRIOR ART

In processing leaf tobacco it is well known to evaluate the quality of the tobacco by determining the distribution by weight of various predetermined sizes of the tobacco leaf in a tobacco sample of a given weight. The weight distribution of the various sizes in the total sample is indicative of the degradation of the tobacco that has occurred during processing. Based on the degradation analysis, quality control standards may be empirically established and used to regulate or control the tobacco processing steps upstream of the tobacco degradation analyzer.

One conventional technique for determining degradation of leaf tobacco during the processing thereof involves the use of a multi-screen vibratory separator apparatus of a type manufactured by The Cardwell Machine Company of Richmond, Virginia. In that conventional apparatus, four screens of decreasing screen size (increasing mesh) are used to separate an approximate six-pound tobacco sample into five fractions of different predetermined sizes of tobacco leaf parts including fines. It should be apparent that where the weight distribution of the sample is greater in the larger size fractions, the higher the quality, or the lesser the degradation, of the tobacco being processed.

The conventional separator apparatus has an impervious endless conveyor on which the tobacco sample is manually deposited and evenly distributed prior to start-up. The conveyor is positioned above the vibratory screens and is arranged to slowly discharge the tobacco sample onto the feed end of the first or uppermost vibratory screen. The smaller size fractions ("underflow") pass through the screen and the larger size fraction ("overflow") is vibrated to the discharge end of the first screen from which it is discharged into a trough and collected in a weigh box for that fraction. Similarly, the overflow of each successive screen is discharged into a trough at the discharge end thereof and collected in a respective weigh box. The tobacco fines which pass as underflow through all screens are collected in a weigh box beneath the last screen. After the tobacco sample has passed through all screens of the vibratory screen apparatus, the screens are manually brushed to clear the screens of any residual tobacco parts which are brushed into the troughs at the discharge end of each screen for passage to the appropriate weigh box. Each of the five weigh boxes is then manually removed from the apparatus and weighed individually on a scale. The weight of each weigh box and sample is manually recorded and the "tare" (the weight of the empty box) is subtracted from the total weight to determine the net weight of each tobacco fraction. The weight distribution of the five fractions is then calculated as a percentage of the total sample weight and a comparison is then made with standard values to determine the relative quality or relative degradation of the tobacco being processed.

Another known apparatus used in the tobacco industry for grading leaf tobacco by the weight distribution of various sizes of the tobacco is known as a Rotex screening machine that was manufactured by Rotex, Inc. of Cincinnati, Ohio. That machine is said to have been manufactured according to U.S. Pat. Nos. 1,688,948; 1,791,291; 1,981,081; 2,047,713; 2,114,406; and 2,149,368. In one conventional form of the Rotex machine, the grading screens are formed by a plurality of inclined pairs of spaced upper and lower screens. A plurality of elastomeric balls are disposed between the cooperating pairs of upper and lower screens. The upper screen comprises the sizing or grading screen and the lower screen supports the elastomeric balls which strike the underside of the upper grading screen during operation of the machine and thereby improve the process of separating the tobacco parts into underflow and overflow. The known Rotex machine is also provided with a blanket of flexible material, such as a rubber sheet, which is slackly disposed on a portion of the uppermost grading screen. The transverse edges or the ends of the blanket may be suspended above the screening surface to provide a curved inlet for the tobacco parts to be screened The relative motion between the vibrating screen and the blanket results in a rubbing action on the tobacco material between the blanket and the screen surface. Such rubbing action improves the separation process and cleaning of the screen by breaking up any cohered tobacco leaf parts and by forcing the appropriately sized tobacco parts through the screen. U.S. Pat. No. 1,981,081 describes one construction of the flexible blanket arrangement described above.

SUMMARY OF THE INVENTION

It is a principal object of the present invention to provide new and improved apparatus and methods for automatically and rapidly analyzing the degradation of tobacco during the processing thereof, and thereby to provide data which can be utilized to regulate and control the processing steps upstream of the point of degradation analysis.

The present invention provides significant improvements in the above-described conventional apparatus and methods for analyzing the degradation of tobacco during processing. According to one important feature of the invention, the degradation analysis is performed by a fully automatic, microprocessor-controlled apparatus which is capable of periodic sampling of an associated tobacco processing line in two modes, namely, a "discrete" mode and a "non-discrete" mode.

In the "discrete" mode of operation, a sample of a predetermined amount by weight of tobacco is (a) diverted from the tobacco processing line, (b) automatically separated, weighed and analyzed according to the weight distribution of four sizes or fractions of tobacco leaf parts and a fifth fraction comprising the tobacco fines contained in the sample and (c) returned to the tobacco processing line. The microprocessor calculates the sum of the weights of all five fractions and the ratio as a percentage of the weight of each fraction to the sum of the weights of all fractions. It will be understood that the present invention contemplates that a greater or lesser number of fractions of the tobacco sample may be utilized if desired. The discrete mode may be operated in "SINGLE" mode in which each sampling is initiated by an operator who manually starts each sampling cycle or an "AUTO" mode in which the operator initiates only the first sampling and subsequent samplings are automatically initiated at preset intervals by the microprocessor.

In the "non-discrete" mode of operation tobacco diverted from the processing line is supplied essentially continuously to the vibratory screening apparatus of the degradation analyzer until a lower set point of the weight of the largest fraction is reached at which time the supply of tobacco to the screening apparatus is stopped. The vibratory screening apparatus is then stopped and the weight of the fifth fraction or tobacco fines is automatically recorded. The vibratory apparatus is then restarted for a timed period to clear the remaining four screens of tobacco parts and the weights of the remaining four fractions are automatically recorded The microprocessor then calculates the same sum of the weights of all fractions and ratios of the fractions to the sum of the weights as in the discrete mode described above. The non-discrete mode may also be operated in a "SINGLE" or "AUTO" mode in the same manner as the discrete mode may be operated The essential difference between the discrete and non-discrete modes of operation is that in the discrete mode a discrete sample of a predetermined weight of tobacco is supplied to the vibratory screening apparatus from the tobacco processing line for degradation analysis, whereas in the non-discrete mode the tobacco sample for degradation analysis is taken from a substantially continuous supply of tobacco diverted from the tobacco processing line and the initiation of the weighing of the five fractions is based on a setpoint of weight for the largest fraction.

According to a presently preferred embodiment of the invention, the degradation analyzer comprises a vibratory screening apparatus similar in construction to the multi-screen vibratory separator apparatus manufactured by The Cardwell Machine Company as described above. Several improvements have been made to that apparatus to overcome inherent disadvantages of the conventional separator apparatus. One such improvement resides in the cleaning or sweeping of the screens of any residual tobacco that is retained on the screens. The cleaning cycle insures that substantially the entire tobacco sample is size graded and that the vibratory screens are substantially cleared of residual tobacco prior to initiation of each subsequent sampling cycle. Cleaning of the screens is achieved by a plurality of sets of brushes, each set of which is arranged to brush and clean the upper surface of a screen disposed beneath such brush set and the lower surface of a screen disposed above such brush set.

Another improvement in the vibratory separator apparatus resides in the endless conveyor which supplies the tobacco sample to the vibratory screens. The conveyor is mounted to the apparatus by four force measuring cells or modules, the outputs of which are summed to provide an output equivalent to the weight of the tobacco on the conveyor at any instant of time. Such output is transmitted to the microprocessor for use in controlling the movement of the conveyor during the discrete and non-discrete modes of operation as described in greater detail hereinafter.

According to another important feature of the invention, the weigh boxes or weigh buckets for each of the five fractions of tobacco are supported on individual electronic weigh scales, the outputs of which are transmitted to the microprocessor for calculating the weight distribution data for the five fractions of the tobacco sample. Each weigh bucket is provided with a power actuated door at the lowermost end thereof for dumping the tobacco fraction contained therein after the fraction weight is recorded in the microprocessor memory. Conveyors disposed beneath the dumping doors for each weigh bucket are provided for returning the discharged tobacco fractions to the tobacco processing line.

It will be appreciated from the foregoing summary that another object of the present invention is to improve the speed and accuracy of the degradation analysis of tobacco during the processing thereof.

A related object of the invention is to provide an improved apparatus for automatically performing a degradation analysis of in-process leaf tobacco with little or no human intervention.

A further related object of the invention is to provide a method of and apparatus for automatically calculating and displaying the weight distribution of a plurality of different size tobacco fractions from a tobacco sample for use in regulating or controlling upstream steps for processing the tobacco.

BRIEF DESCRIPTION OF THE DRAWINGS

The above and still further objects, features and attendant advantages of the present invention will become apparent to those skilled in the art from a consideration of the following detailed description of a presently preferred embodiment thereof, taken in conjunction with the accompanying drawings in which.

DETAILED DESCRIPTION OF A PREFERRED EMBODIMENT

Figure 1:
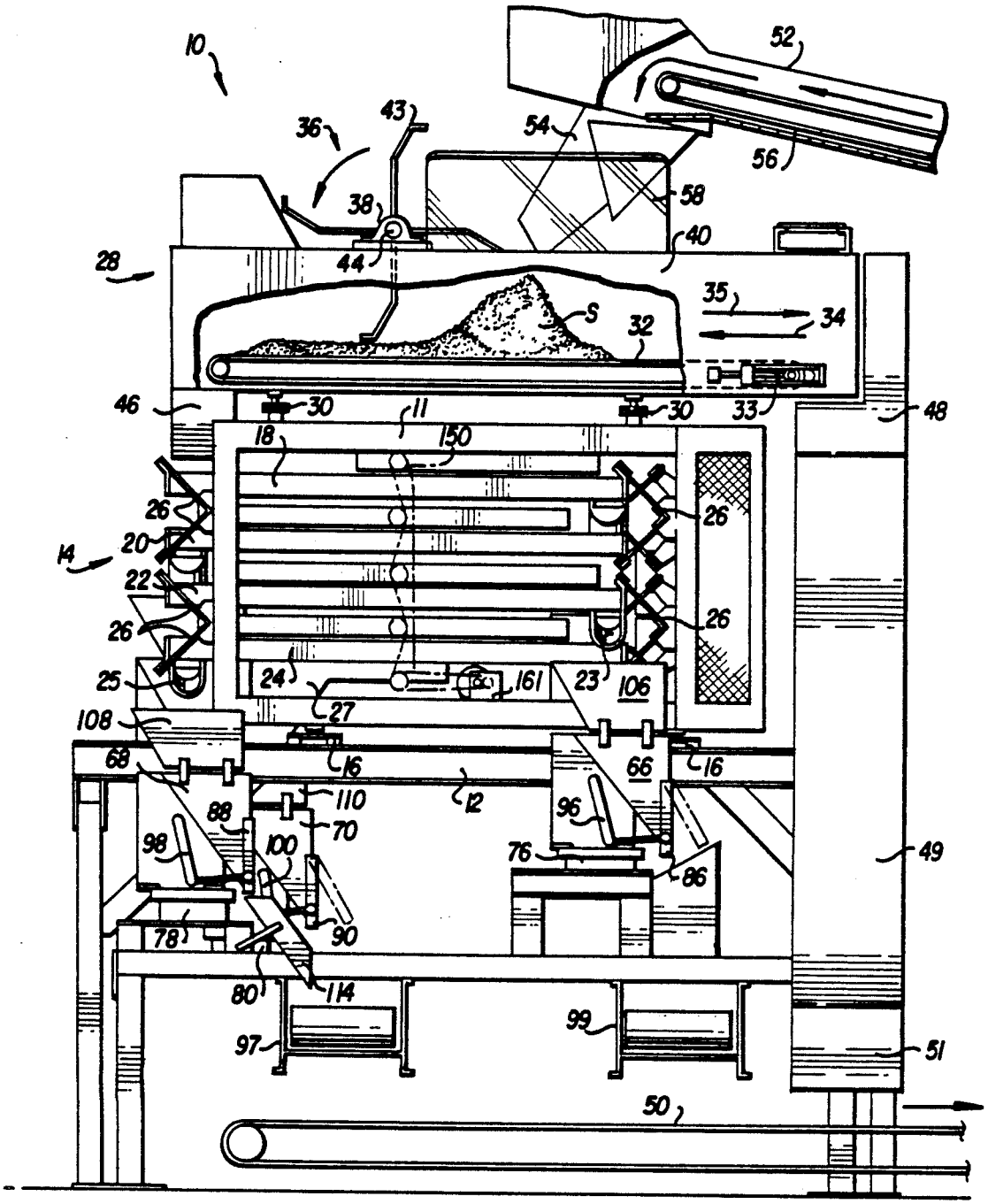
FIG. 1 is a front elevation view, partly in section, of the apparatus according to a preferred embodiment of the invention.
Figure 2:
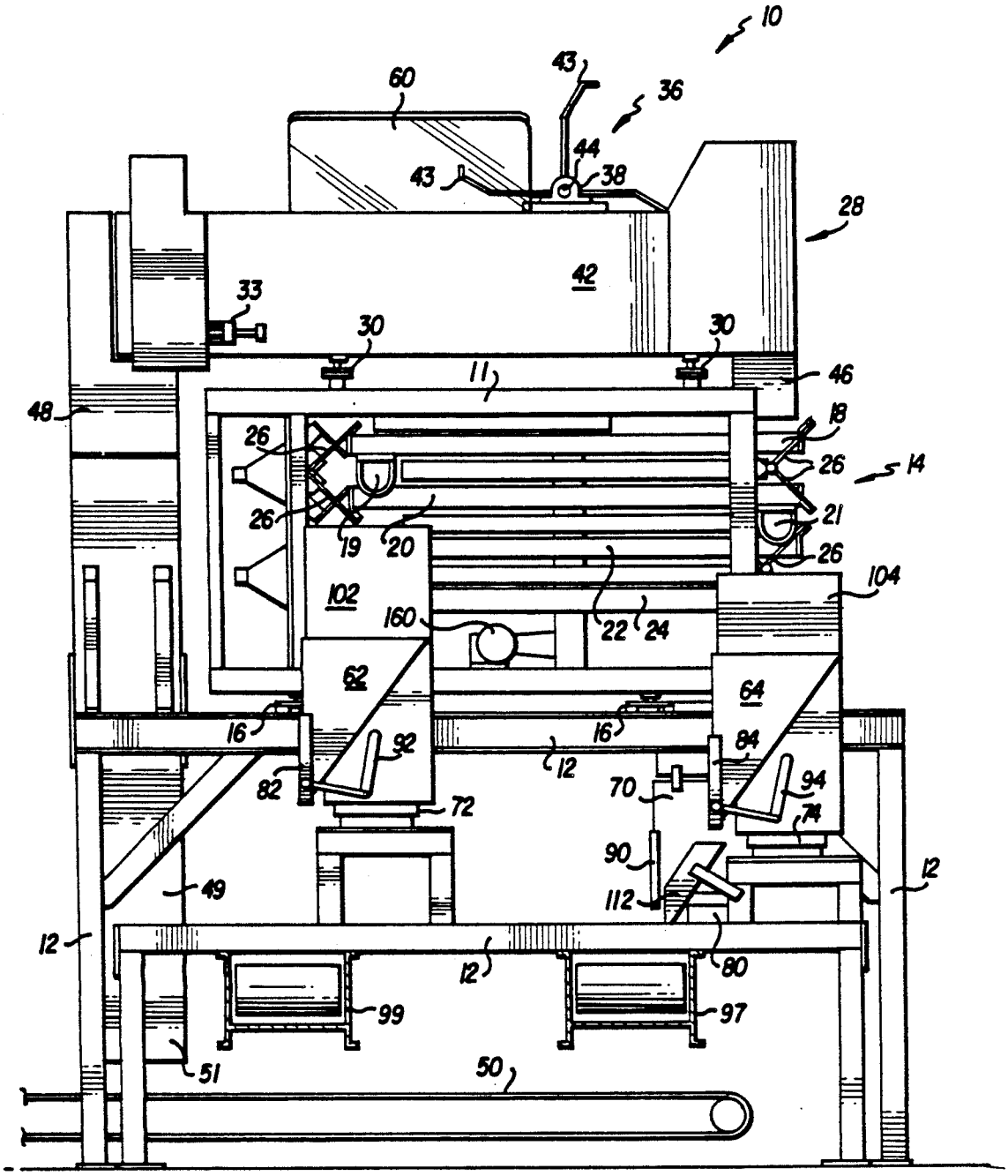
FIG. 2 is a back elevation view of the apparatus of FIG. 1.
Figure 3:
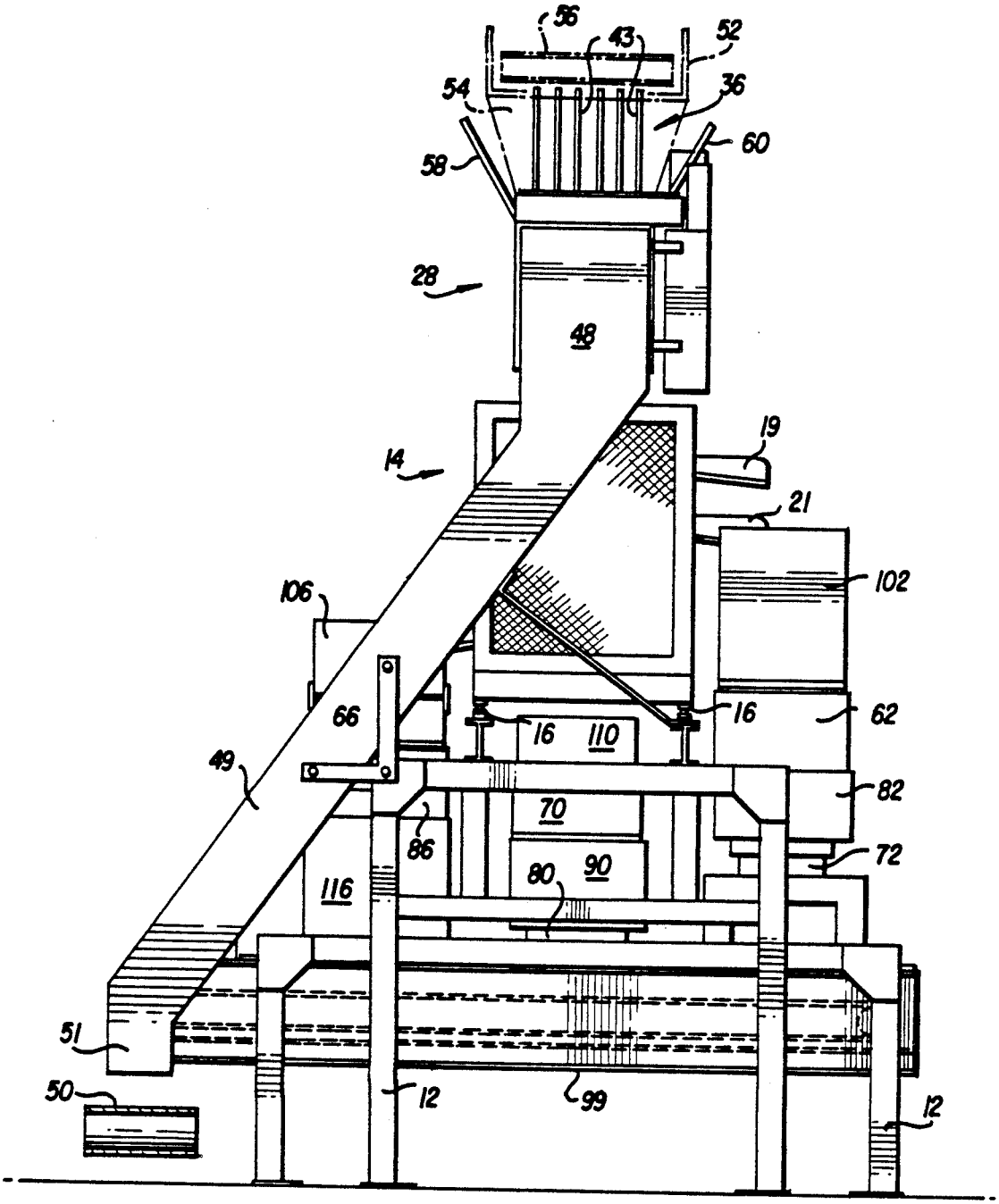
FIG. 3 is an end elevation view of the apparatus of FIG. 1.
Figure 4:
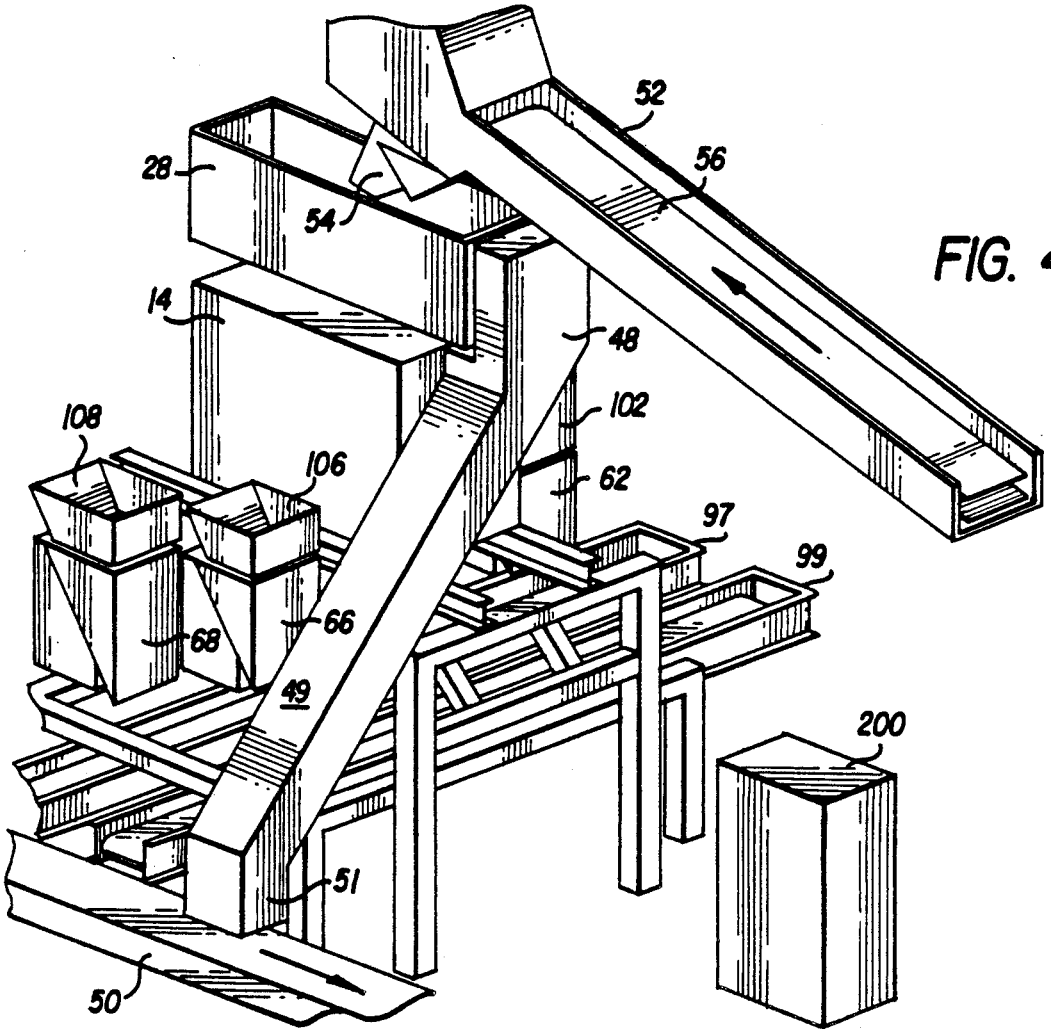
FIG. 4 is a perspective view of a portion of the apparatus of FIG. 1.

Referring now to the drawings, and particularly to FIGS. 1–4, the automatic degradation analyzer 10 of the present invention is shown in front, back and end elevation views and a partial perspective view, respectively. The degradation analyzer 10 comprises a base 12 on which is mounted a multi-screen vibratory separator 14. The separator 14 has a supporting frame 11 which is mounted to the base 12 by means of four isolation mounts 16 of conventional construction. The separator 14 comprises a plurality of screens 18,20,22,24 arranged one above the other and mounted to the separator frame 11 by resilient straps or springs 26 in a known manner. The details of the construction and operating of the vibratory separator 14 and the screen cleaning means therefor are described hereafter in connection with FIG. 6.

Each screen has a respective discharge trough arranged transversely across the downstream end of the screens, i.e., the end of the screen from which the overflow is discharged. Thus, the uppermost two screens 18,20 discharge overflow into respective troughs 19,21 toward the rear of the degradation analyzer (FIG. 2) and the lowermost two screens 22,24 discharge overflow into respective troughs 23,25 toward the front of the degradation analyzer (FIG. 1). The underflow from the lowermost screen 24 is discharged from an underflow chute 27 disposed beneath screen 24.

Weigh buckets 62,64,66,68 are arranged beneath the discharge troughs 19,21,23,25, respectively, for receiving the overflow from each of the screens 18,20,22,24 and weigh bucket 70 is disposed beneath the underflow chute 27 for receiving the underflow (tobacco fines) from the lowermost screen 24. Each weigh bucket 62–70 is supported on a respective electronic weigh scale 72,74,76,78,80, the outputs of which are transmitted to the microprocessor. Each weigh bucket 62-70 is provided with a pivotable door 82,84,86,88,90 at the lower end thereof which is actuable to open or close under control of the microprocessor by means of a pneumatically or electrically operated linkage 92,94,96,98,100. When opened, the pivotable doors of all the buckets 62–70 are arranged to dump the tobacco in the buckets onto a pair of transverse take-away conveyors 97,99 which discharge the tobacco onto conveyor 50 for return to the tobacco processing line.

The weigh buckets 62–70 have a wedge-like shape with a gradually increasing rectangular cross section from the lowermost end to the top thereof. The pivotable door is arranged on the forward vertical wall of the bucket so that when the door is pivoted open, the flow of tobacco out of the bucket is along the inclined interior surface of the bucket. That construction of the weigh buckets and doors advantageously minimizes the possibility of "bridging" of the tobacco within the bucket. "Bridging" is an undesirable phenomenon in which a particulate material becomes sufficiently compacted or interconnected to form a "bridge" of material which resists outflow from a container.

It has been found desirable to provide inlet extensions to the upper inlet ends of the weigh buckets to increase the volume of the weigh buckets for the larger tobacco fractions and to decrease the distance between the bucket inlet and the trough discharge for each screen. Thus, inlet extensions 102,104,106,108,110 are provided for a respective weigh bucket 62–70. Similarly, outlet extensions are provided where necessary to insure that the tobacco discharged from each bucket is directed onto one of the transverse conveyors 97,99 transporting the dumped tobacco fractions to the return conveyor 50. Weigh buckets 64 and 68 are thus provided with inclined discharge chutes 112,114 respectively, which extend over the upper reach of conveyor 97. Weigh bucket 66 is provided with a vertical discharge chute 116 which extends over the upper reach of conveyor 99. Weigh bucket 62 may also be provided with a similar vertical discharge chute if desired.

Figure 9:
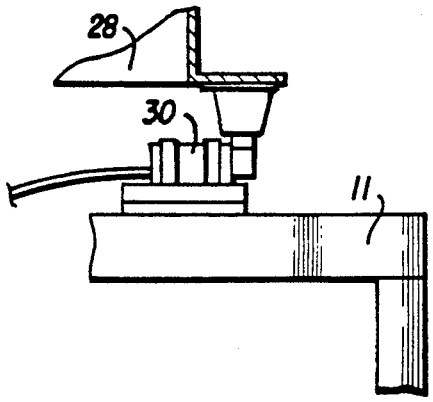
FIG. 9 is a fragmentary detail showing one of the force cells used to determine the weight of the sample on the weigh conveyor.

A weigh conveyor 28 is mounted to the separator frame 11 superposed over the uppermost screen 18 of the separator 14. The weigh conveyor 28 is supported on the frame by means of four conventional force measuring cells 30 (FIG. 9) of a type manufactured by Toledo Scale, Masstron Scale Division of Columbus, Ohio and designated 650 59-250. The four weights are summed in "summing box" designated 20034-4 (also manufactured by Toledo Scale) to obtain total weight. The weigh conveyor 28 comprises an endless conveyor belt 32 which is driven by a reversible motor (not shown) under control of the microprocessor so that the upper reach of the conveyor belt 32 is movable to convey in both horizontal directions as shown by the arrows 34,35. A conventional conveyor adjustment mechanism 33 is mounted to the conveyor roll at one end of the conveyor belt 32 for adjusting the tension of the belt.

A leveler means 36 is rotatably mounted in bearing blocks 38 on the sidewalls 40,42 of the conveyor 28 for rotation by motor means (not shown). The leveler means 36 comprises a plurality of rods 43 bent as shown in FIG. 1 and mounted to a shaft 44 in a plurality of bores spaced 90° from one another about the shaft. In a preferred form of the leveler means 36, the shaft 44 between the bearing blocks 38 has a rectangular cross-section and the rods 43 are mounted in longitudinally spaced planes from one end of the shaft to the other, with a pair of rods spaced 180° apart mounted in each plane, the rods of one pair being arranged 90° from the rods of a next adjacent rod pair. The shaft 44 is rotated counterclockwise as seen in FIG. 1 by the motor means (not shown) so as to level the upper surface of a tobacco sample S as the sample is conveyed along the upper reach of conveyor belt 32 in the direction shown by the arrow 34. The height of the leveler 36 is adjustable up and down to deliver the sample S according to a predetermined feed rate for tobacco of different densities, sizes or the like. For example, a more dense tobacco is leveled at a lower height to accommodate the same feed rate as compared to a less dense tobacco. Feed rates varying from about 5 to about 10 minutes for an approximately six pound sample are presently preferred.

Chutes 46,48 are provided at opposite ends of the conveyor apparatus for discharge of the tobacco sample S. Chute 46 discharges the tobacco sample S to the vibratory separator 14 for a degradation analysis of the sample and chute 48 discharges the tobacco sample S to a return conveyor 50 via an inclined chute portion 49 and outlet 51.

Suspended above the weigh conveyor 28 is an inclined conveyor 52 with an outlet chute 54. The upstream end of conveyor 52 (not shown) is arranged in the tobacco processing line in a known manner to divert the tobacco from the processing line to the conveyor belt 56 which is driven by a reversible motor (not shown) so as to convey tobacco from the processing line to the outlet chute 54 or to return tobacco on the upper reach of the conveyor belt 56 to the tobacco processing line. The direction of movement of the conveyor is belt 56 is controlled by the microprocessor. A pair of deflector plates 58,60 are mounted on the upper ends of the conveyor sidewalls 40,42 to prevent spillage of the tobacco as it is discharged from the outlet chute 54 of conveyor 52.

Figure 6:
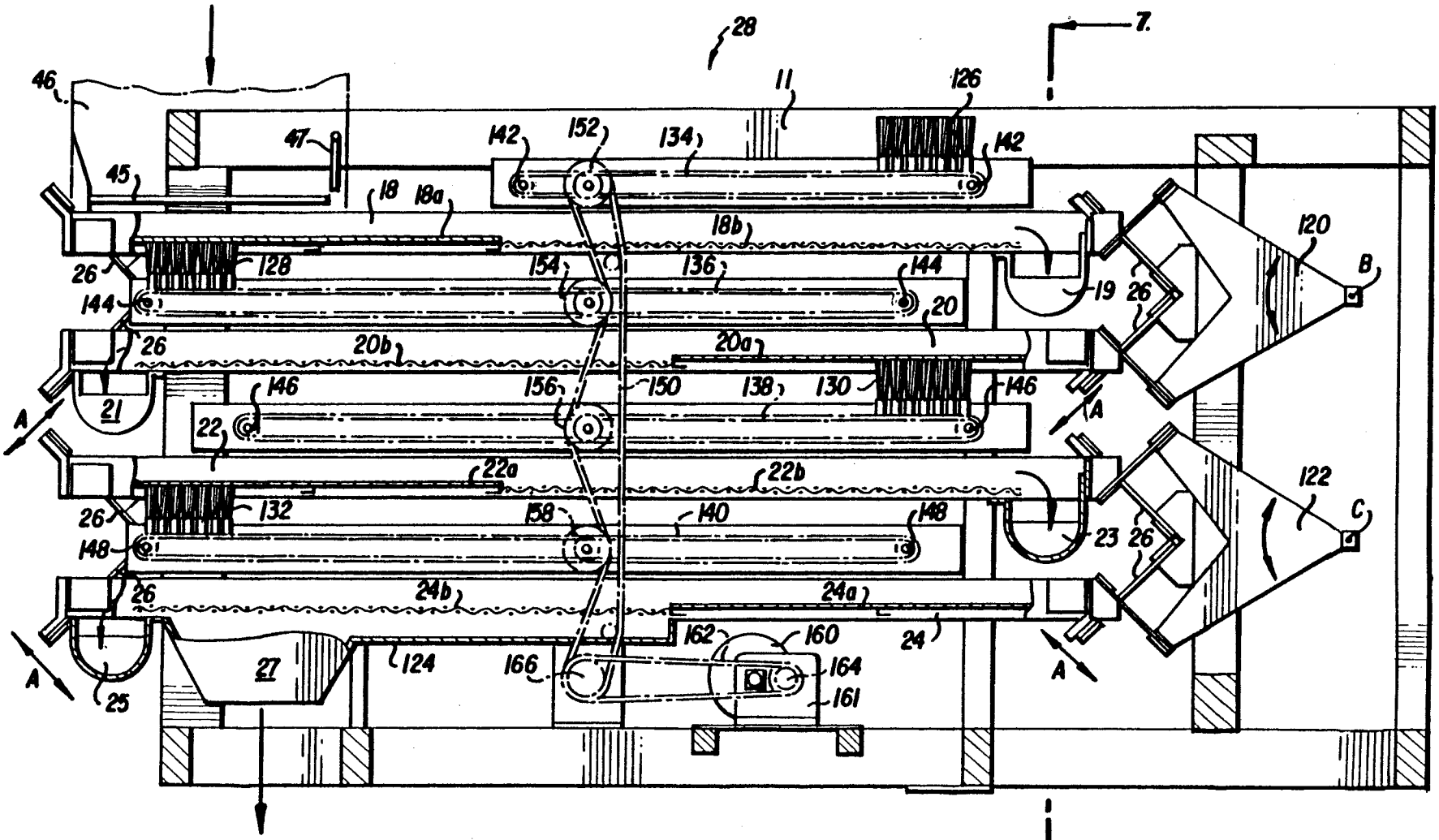
FIG. 6 is a side elevation view, partly in section, of the vibratory screening apparatus of the preferred embodiment of the present invention.
Figure 7:
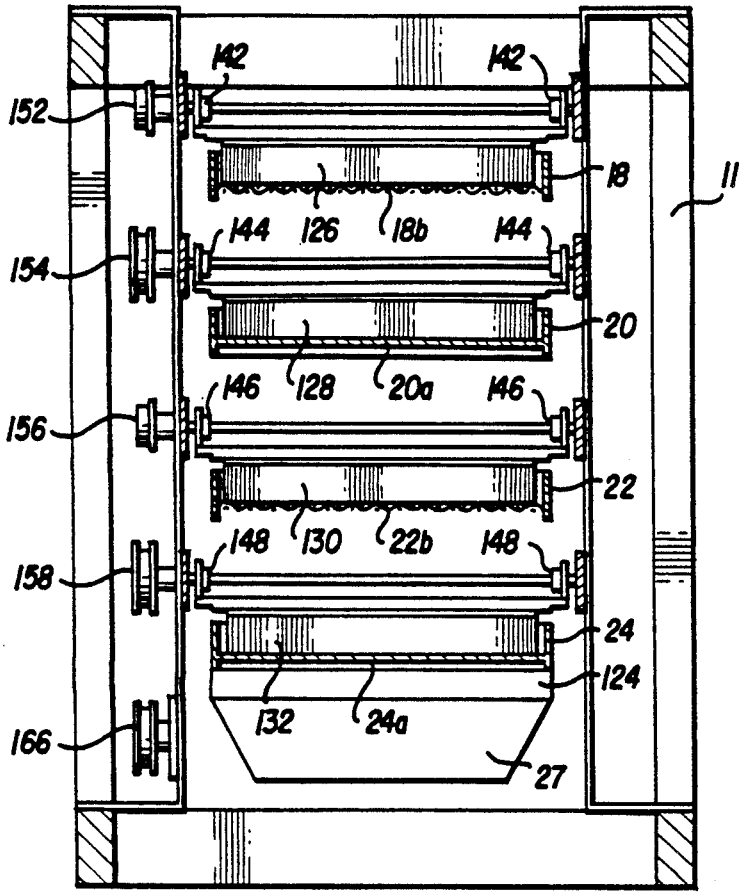
FIG. 7 is an end elevation view of the vibratory screening apparatus of FIG. 6 taken along line 7—7.
Figure 8:
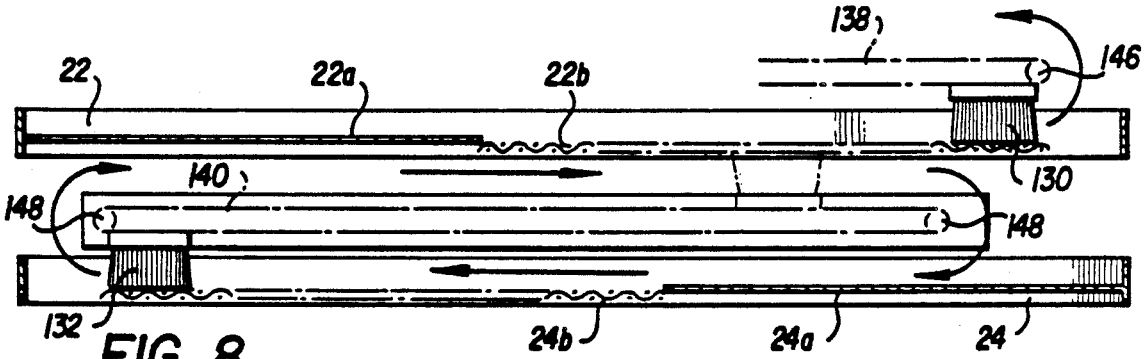
FIG. 8 is a detail of the vibratory screening apparatus of FIG. 6 illustrating the process of cleaning the vibratory screens.

Referring now to FIGS. 6–8, the vibratory screening apparatus 28 will be described in greater detail. As best seen in FIG. 6, each screen 18–24 is resiliently mounted to the frame 11 by means of four flat straps or springs 26 (only two shown for each screen) The springs 26 are longitudinally and transversely stiff but are flexible in both directions normal to the flat faces of the spring as illustrated by the arrows A in FIG. 6. The screens are vibrated by means of rocker arms 120,122 which are each oscillated about pivot points B and C by a respective shaker motor (not shown) in a well known manner. Oscillation of the rocker arms 120,122 drives the screens in a vibratory motion which causes the tobacco to be sampled to pass from left to right over screens 18 and 22 and from right to left over screens 20 and 24 as viewed in FIG. 6.

Each screen comprises an impervious portion 18*a*,20*a*,22*a*,24*a* and a mesh portion 18*b*,20*b*,22*b*,24*b*, the latter having a predetermined mesh number. The screens are provided in a descending size order from top-to-bottom; sizes are chosen by the user according to the user's requirements and according to the material to be analyzed, e.g., tobacco, strip, cut filler, scrap, etc. In a presently preferred embodiment, screen portion 18*b* is 1-inch mesh, screen portion 20*b* is 2 mesh, screen portion 22*b* is 4 mesh and screen portion 24*b* is 8 mesh. In another embodiment of the screening apparatus, the screens are ASTM-E-11-70 type screens of seive designations and wire diameters as follows: 1.0 inch and 0.1496 inch; 0.50 inch and 0.1051 inch; 0.250 inch and 0.0717 inch; Number 8 mesh and 0.0394 inch.

The impervious portions 18*a*–24*a* of the screens are provided so that the underflow from a given screen will pass over substantially the entire screening area of the screen disposed below such given screen. In addition, the fifth fraction or tobacco fines is advantageously separated in the central portion of the screening apparatus so that carry-over of fines with other fractions is also minimized.

A plurality of rods or tines 45 are arranged in spaced relation in a horizontal plane and other rods or tines 47 in a vertical plane at the lower end of the chute 46 superposed over the impervious portion 18*a* of screen 18. The tines 45 and 47 advantageously help to more evenly distribute the tobacco sample over the entire transverse area of the impervious portion of the screen 18.

It will be apparent to those skilled in the art that a first fraction of the tobacco sample having a particle size larger than the mesh of screen 18*b* will pass as overflow from the inlet chute 46 over impervious and mesh portions 18*a* and 18*b* and into discharge trough 19. The underflow from mesh portion 18*b* falls to screen 20 where a second fraction of the tobacco sample having a particle size impervious and mesh portions 20*a* and 20*b* and into discharge trough 21. The underflow from mesh portion 20*b* falls to screen 22 where a third fraction of the tobacco sample having a particle size larger than the mesh screen 22*b* will pass as overflow over impervious and mesh portions 22*a* and 22*b* and into discharge trough 23. The same result occurs with respect to the fourth fraction and screen 24. The underflow from mesh portion 24*b* of the lowermost screen 24 falls as the fifth fraction (tobacco fines) into an impervious collector pan 124 from which it is carried to discharge chute 27.

A plurality of brush means 126,128,130,132 are provided for cleaning the upper and lower screening surfaces of each mesh portion 18*b*–24*b*, except for the lower surface of mesh portion 24*b* as will be described hereafter. Each brush means 126–132 preferably comprises a set of eight rows of elongated brush elements (FIG. 7), however, a greater or lesser number of brush elements may be used for each brush means. In FIG. 6, the brush means 126–132 are shown in a position for screening of the sample.

The elements of each brush means 126–132 are connected at their opposite ends to a pair (only one shown) of endless chains 134,136,138,140 each of which is trained about a pair of spaced sprockets 142,142,146,148. Movement of the chains 134–140 will cause each brush to travel along the path of the chain to which it is connected. Movement of the endless chains is effected by a drive chain 150 and a plurality of double drive sprockets 152,154,156,158 which engage drive chain 150 and a respective one of the endless chains 134–140. Drive chain 150 is driven by a conventional motor 160 and gearbox 61 by means of a chain 162 and sprockets 164,166.

Assuming sprocket 166 is driven counterclockwise as viewed in FIG. 6, chain 150 will drive double sprockets 152 and 156 counterclockwise and double sprockets 154 and 158 clockwise. That will cause the brush means 126 and 130 to move from right to left over the upper run of the chains 134 and 138 and from left to right over the lower run of the chains 134 and 138. In like manner, the brush means 128 and 132 will move from left to right over the upper run of chains 136 and 140 and from right to left over the lower run of the chains 136 and 140. That movement of the brush means will cause (1) the brush means 126 to clean the upper surface of the mesh portion 18*b*; (2) the brush means 128 to clean the lower surface of the mesh portion 18*b* and the upper surface of the mesh portion 20*b*; (3) the brush means 130 to clean the lower surface of mesh portion 20*b* and the upper surface of mesh portion 22*b*; and (4) brush means 132 to clean the lower surface of the mesh portion 22*b* and the upper surface of the mesh portion 24*b*. The lower surface of mesh portion 24*b* is not cleaned with the brush means, however, the underflow from lowermost screen 24 constitutes tobacco fines. Therefore, if any residual tobacco remains on the underside of the mesh portion 24*b*, it is likely to be a relatively small amount by weight.

FIG. 8 illustrates how the brush means 130 and 132 of the lowermost two screens 22 and 24 are driven by their respective endless chains 138,140 over the surfaces of mesh portions 22*b* and 24*b*. Since the brush means 130,132 are constructed of a plurality of individual elongated brush elements which are connected at their ends to separate links of the chains 138,140, the brush means can readily pass about the small diameter sprockets 146,148 at the ends of the runs of the chains.

FIG. 7 illustrates a cross-section of the vibratory separator 28 along the line 7—7 with the brush means 126–132 shown in the cleaning position with the free ends of the brushing elements bearing against a respective mesh portion 18*b*–24*b* of the screens 18–24. The brush means 128 and 132 are located on the lower run of their respective endless chains 136 and 140 at the remote ends thereof as viewed in FIG. 7, i.e., adjacent the discharge troughs 21 and 25, respectively.

Figure 5:
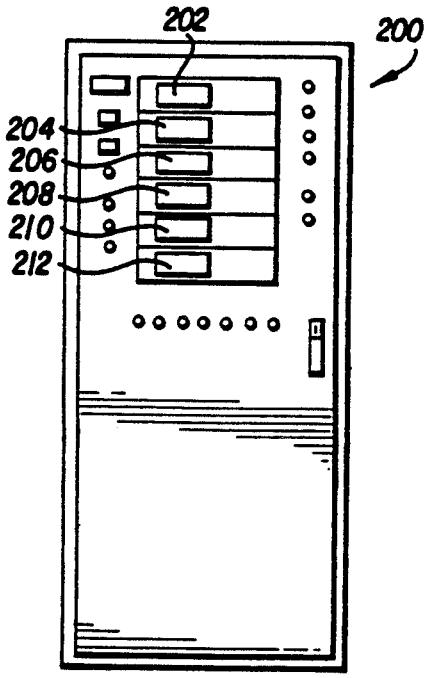
FIG. 5 is a front elevation view of the control console for the apparatus of FIG. 1.

With reference now to all the drawings, the operation of the degradation analyzer 10 will be described in the two modes of operation, namely, the "discrete" and "non-discrete" sampling modes. The analyzer 10 is controlled by a microprocessor located in a control console 200 (FIGS. 4 and 5) from which an operator controls the initiation of the selected sampling mode and makes any desired or appropriate changes in the system parameters such as sample weight setpoints, weigh bucket and weigh conveyor tare and the like. The construction of the control console, the microprocessor and the computer program for controlling the operation of the degradation analyzer are not set forth in detail herein and are considered to be within the capabilities of those skilled in the art of utilizing computers to control the operation of complex equipment.

Before initiating a sampling of tobacco from the tobacco processing line, tare is set on the weight readouts 202,204,206,208,210 for each of the empty weigh bucket weight scales 72–80. Tare is also set for the weigh conveyor 32 on its weight readout 212 on the control console. When all weight scales are set at tare or zero the operator initiates a sampling cycle, for example, in the discrete SINGLE mode. It will be understood that each of the below described movements or functions of the apparatus is the result of a signal or signals transmitted by the microprocessor in accordance with a predetermined program.

Upon initiation of the sampling cycle in the "discrete" mode, the inclined conveyor 52 diverts tobacco flow from a remotely located tobacco processing line (not shown) and conveys the tobacco up conveyor belt 56 where it is discharged via outlet chute 54 onto the conveyor belt 32 of weigh conveyor 28. When the lower setpoint of weight on the conveyor belt 32 is reached, e.g., six pounds of tobacco, as determined by the output of weigh cells 30, the conveyor belt 56 is reversed so that no more tobacco is supplied to the weigh conveyor. If the weight of tobacco supplied to the conveyor belt 32 exceeds an upper setpoint of weight, the conveyor 56 reverses and the conveyor 32 is energized so as to convey the overweight sample S of tobacco in the direction 35 and discharge it via chute 48, inclined chute portion 49 and outlet 51 onto conveyor 50 for return to the tobacco processing line. The conveyor belt 32 stops after a timed period and a new sampling cycle begins.

Assuming a tobacco sample S within the upper and lower weight setpoints has been supplied to the weigh conveyor 32, the weight of the sample is recorded in memory and the pivotable doors 82–90 of the weigh buckets 62–70 are closed. The vibratory shaker motors are energized to vibrate the screens 18–24 and the conveyor belt 32 moves the sample S in the forward direction, i.e., in the direction shown by the arrow 34. As the sample S moves forwardly, the leveler means 36 is operated counterclockwise as viewed in FIG. 1 to level the upper surface of the tobacco sample at about a six-inch height above the conveyor 32. The shaker motors and the conveyor 32 run for a predetermined time period sufficient to permit the tobacco sample to be delivered from the conveyor 32 to the vibratory screening apparatus 28 and separated into the five sizes or fractions of tobacco as previously described. The screen cleaning process is initiated by starting the cleaning motor 160. The brush means 126–132 pass over and under the screens 18–24 to brush any residual tobacco parts from the screens into the troughs 19–25 aided by the vibratory action of the shaker motors. The cleaning cycle continues for a predetermined time which may be increased or decreased depending on the effectiveness and desired thoroughness of the cleaning.

The weights of the five weigh buckets 62–70 are taken and the weights of the five sizes or fractions are recorded in memory. After all the weights are recorded in memory, the transverse take-away conveyors 97,99 are started and the pivotable doors 82–90 of all the weigh buckets 62–70 are opened, for example, by pneumatic operation of the door linkages 92–100, to dump the five tobacco fractions onto the conveyors 97,99 which convey and discharge the fractions on the conveyor 50 for return to the tobacco processing line. After the weigh buckets are dumped, cleaning air may be supplied for a timed period to the interior of each weigh bucket to insure that all residual tobacco parts are discharged from the buckets.

During the time the weigh buckets are dumped the microprocessor calculates the sum of the weights of the tobacco fraction in the weigh buckets and the ratio as a percentage of the weight of each tobacco fraction to the total (summed) weight of the tobacco sample. The microprocessor then commands a printout of the calculated data with an identifying sample number, the time, date and the mode of operation, i.e., "discrete." If tee sampling procedure was initiated in the SINGLE mode a new cycle will have to be initiated by the operator, but if in the AUTO mode, a periodic sampling in the "discrete" mode will be taken.

In the "non-discrete" mode, the sampling is performed on a more-or-less continuously supplied sample of tobacco. The "non-discrete" mode will be described only to the extent it differs from the "discrete" mode. After initiation of the "non-discrete" SINGLE mode, for example, the inclined conveyor 52 diverts tobacco flow from the remotely located tobacco processing line and conveys tobacco up conveyor belt 56 where it is discharged via outlet chute 54 onto the conveyor belt 32. When a lower setpoint of weight (substantially lower than the weight setpoint for a full sample in the "discrete" mode) on the conveyor belt 32 is reached, the conveyor belt 56 reverses, the conveyor belt 32 is started in the forward direction indicated by the arrow 34 and the shaker motors are started. If the upper setpoint is exceeded, the tobacco on the belt 32 is discharged and conveyed back to the processing line as in the discrete mode.

Assuming the proper lower setpoint was reached, the sample is supplied to the vibratory screening apparatus via chute 46. During this time, the weight of the tobacco on the conveyor 32 is continuously monitored to ensure that a minimum weight of tobacco, e.g., two pounds, is on the belt at all times. If the weight becomes light, the conveyor 56 is operated to add tobacco the belt 32 until the minimum weight is maintained. This procedure provides a substantially continuous flow-through of tobacco in the vibratory screening apparatus 14 with the weigh buckets open. Then with the shaker motors and conveyor belt 32 operating, the bucket doors are closed as in the "discrete" mode. The weight of the weigh bucket 62 for the top or largest size fraction is monitored during the period after the bucket doors are closed. When the weight of the tobacco in bucket 62 reaches a lower set-point for weight, the conveyor 52 will continue in the reverse direction and the conveyor belt 32 stops. The screen cleaning process continues as in the "discrete" mode. When a new sampling is to be made, the system is restarted if in the SINGLE mode or automatically continued if in the AUTO mode. However, after the first sample is taken in the "non-discrete" mode, subsequent samples may be rapidly taken since the conveyor belt 32 is loaded with approximately two pounds of tobacco ready for sampling.

Although certain presently preferred embodiments of the invention have been described herein, it will be apparent to those skilled in the art to which the invention pertains that variations and modifications of the described embodiment may be made without departing from the true spirit and scope of the invention. Accordingly, it is intended that the invention be limited only to the extent required by the appended claims and the applicable rules of law.

What is claimed is:

1. Apparatus for analyzing the degradation of leaf tobacco during the processing thereof comprising:

means for selecting a sample of tobacco from a tobacco processing line for degradation analysis, said selecting means comprising a weigh conveyor means receiving a supply of tobacco from said processing line for weighing the supplied tobacco and for producing an output signal proportional to the weight of the sample of tobacco to be analyzed;

means for separating the selected sample of tobacco into a plurality of different-sized fractions of tobacco, said separating means comprising a plurality of screen means over which said sample is passed in succession, said screen means having upper and lower surfaces, said weight conveyor means being arranged to deliver the selected sample of tobacco to a first one of said screen means;

means associated with said separating means for automatically cleaning residual tobacco of the sample from the surfaces of at least some of said screen means;

means for collecting and weighing each of the different-sized fractions of tobacco and for producing output signals indicative of the weights of each tobacco fraction; and means for receiving said output signals and for calculating the percentage by weight of each fraction of tobacco to the total weight of the tobacco fractions as an indication of the degradation of the tobacco being processed.

2. The apparatus of claim 1, wherein said cleaning means for said screen means comprises a plurality of brush means for sweeping the residual tobacco from the surfaces of the screen means into said receiving and weighing means.

3. The apparatus of claim 2, including a first and second screen means, at least one of said brush means being arranged to sweep the upper surface of one of said first and second screen means and the lower surface of the other of said first and second screen means.

4. The apparatus of claim 3, wherein said first screen means is superposed over said second screen means and said brush means is arranged to sweep the lower surface of the first screen means.

5. The apparatus of claim 2, including a plurality of screen means arranged one above the other in vertically spaced relation, at least some of said plurality of brush means being arranged between adjacent pairs of said screen means, means for driving each of said brush means so as to sweep the lower surface of one of said screen means of an adjacent pair and the upper surface of the other of the screen means of said adjacent pair, said one screen means being disposed vertically above the other screen means.

6. The apparatus of claim 5, wherein said means for driving said brush means comprises means connected to a respective brush means for endlessly moving said brush means along vertically spaced upper and lower paths of travel such that the brush means sweeps the lower surface of said one screen means as it moves along the upper path of travel and sweeps the upper surface of said other screen means as it moves along the lower path of travel.

7. The apparatus of claim 6, wherein said driving means for each brush means comprises an endless chain trained about a pair of sprockets arranged adjacent the opposite ends of said screen means, said brush means being connected to said endless chain, a drive sprocket engaging each endless chain, a drive chain engaging each drive sprocket and a drive motor engaged with said drive chain for driving said drive chain and thereby the drive sprockets engaged with said drive chain.

8. The apparatus of claim 5, including a further brush means arranged above the uppermost one of said screen means and means for driving said further brush means so as to sweep the upper surface of the uppermost screen means, said means for driving said further brush means comprising an endless chain trained about a pair of sprockets arranged above and adjacent the ends of said uppermost screen means.

9. The apparatus of claim 1, wherein said plurality of screen means comprises four vertically spaced screens each having a screen of a different mesh size for separating five different-sized fractions of said tobacco sample, means for simultaneously vibrating said four screens to cause the fraction separated by each screen to travel as overflow from one end of said screen to an overflow discharge end thereof, the fifth fraction passing through the lowermost screen as underflow.

10. The apparatus of claim 9, wherein said screen mesh sizes are 1-inch mesh, 2 mesh, 4 mesh and 8 mesh, respectively, from the uppermost to the lowermost screen.

11. The apparatus of claim 1, including reversible means connected to said weight conveyor means for driving said weigh conveyor means in both directions of travel.

12. The apparatus of claim 1, wherein said weight conveyor means comprises an endless conveyor supported on force measuring means for measuring the weight of the conveyor and the tobacco sample thereon.

13. The apparatus of claim 1, wherein said means for selecting a sample of tobacco further comprises a second conveyor means for supplying tobacco to the weigh conveyor means from the tobacco processing line, second reversible means connected to said second conveyor means for driving said second conveyor means in both directions so as to supply tobacco to the weigh conveyor means in one direction of movement and to return tobacco to the tobacco processing line in the other direction of movement.

14. The apparatus of claim 1, wherein said weigh conveyor means has first and second discharge ends, said first discharge end being arranged to deliver the tobacco sample to the first screen means, third conveyor means being arranged at the second discharge end of the weigh conveyor means for returning the tobacco sample to the tobacco processing line.

15. The apparatus of claim 14, including a first chute arranged between the first discharge end of said endless conveyor and the first screen means and a second chute arranged between the second discharge end of said endless conveyor and said third conveyor means.

16. The apparatus of claim 1, including leveler means arranged above said weigh conveyor means for maintaining the height of the tobacco sample on the weigh conveyor means at a predetermined height level and means associated with said leveling means for adjusting said leveler means to vary the predetermined height level of the tobacco sample.

17. The apparatus of claim 1, including microprocessor means operative to receive the output signals of each electronic weigh scale means for calculating the percentage by weight of each tobacco fraction to the total weight of the tobacco fractions, and display mean for displaying the weights of each tobacco fraction, the total weight of the tobacco fractions and the percentage by weight of each tobacco fraction to the total weight of the tobacco fractions.

18. The apparatus of claim 1, wherein each weigh bucket means comprises a bucket having a first opening for receiving a tobacco fraction, a second opening in said bucket for discharging the tobacco fraction after weighing the door means associated with the second opening for selectively opening and closing the second opening.

19. The apparatus of claim 18, wherein each bucket comprises a wedge-shaped box having an internal volume for retaining the tobacco sample for weighing, the cross sectional area of said box being rectangular and decreasing from the first opening to the second opening of the bucket, said box having an inclined wall and a vertical wall disposed opposite said inclined wall, said door means being arranged in said vertical wall and being pivotable in a direction to increase the cross-sectional area of the box adjacent the second opening to permit flow of the tobacco out of the box along the inclined wall thereof.

20. The apparatus of claim 18, including conveyor means arranged to receive the tobacco fractions discharged from the second opening of each bucket for returning the weighed tobacco fractions to the tobacco processing line.

21. The apparatus of claim 1, including a plurality of screen means arranged one above the other in vertically spaced relation, each screen means having an impervious portion arranged above a previous mesh portion of the screen means disposed immediately therebelow, each screen means further having an overflow discharge end, the discharge end of each screen means being arranged above the impervious portion of the screen means disposed immediately below such discharge end.

22. The apparatus of claim 21, including a discharge trough arranged at the overflow discharge end of each screen means and an underflow chute arranged beneath the lowermost screen means for delivering the overflow tobacco fraction of each screen means and the underflow tobacco fraction of the lowermost screen means to said receiving and weighing means.

23. The apparatus of claim 21, including means for vibrating each of said screen means such that portions of the tobacco sample travel over each screen means in a direction from the impervious portion toward the discharge end thereof.

24. Apparatus for receiving a selected sample of particulate material and separating the sample into a plurality of different-sized fractions of material comprising:

a plurality of screens arranged in vertically spaced relation, the overflow of each screen comprising one of said fractions, the underflow of the lowermost screen comprising the smallest size fraction of said plurality of fractions;

brush means arranged adjacent said screens and movable over said screens for sweeping material of the sample from the surfaces of the screens as overflow;

driving means connected to the brush means for moving the brush means over the screen surfaces; and control means for activating the driving means at a predetermined time during the separation of the sample into fractions whereby residual material remaining on the screens may be sWept from the screens as overflow from said screens or separated as underflow from the lowermost screen.

25. Apparatus according to claim 24, wherein said screens have upper and lower surfaces and are superposed one above the other, said brush means being arranged between adjacent pairs of said screens so as to move over the lower surface of the uppermost one of an adjacent screen pair and to move over the upper surface of the lowermost one of such adjacent screen pair.

26. Apparatus according to claim 25, wherein said driving means comprises means for moving said brush means over an endless path of travel disposed between each adjacent pair of screens.

27. Apparatus according to claim 25, wherein said driving means comprises endless chains trained about sprockets arranged between each adjacent pair of screens, a drive sprocket engaging each endless chain, a drive chain drivingly engaging each drive sprocket and a drive motor drivingly engaging the drive chain.

28. Apparatus according to claim 24 including means for supplying the selected sample to the uppermost screen, said supplying means comprising weigh conveyor means for receiving the selected sample and for weighing the same.

29. Apparatus according to claim 28, including reversible means for driving said weigh conveyor means in first and second directions, said weigh conveyor means having first and second discharge ends, said first discharge end being arranged above the uppermost screen for discharging the sample to the uppermost screen when the weigh conveyor means is driven in the first direction, said second discharge end being arranged to discard the sample when the weigh conveyor means is driven in the second direction.

30. Apparatus according to claim 24, wherein said particulate material is leaf tobacco from a tobacco processing line.

31. Apparatus according to claim 30, wherein said plurality of screens comprise four screens each having a screen of a different mesh size for separating five different-sized fractions of tobacco, said screen mesh sizes being 1-inch mesh, 2 mesh, 4 mesh and 8 mesh, respectively, from the uppermost to the lowermost screen.

32. Apparatus according to claim 24, including means for vibrating said screens, each screen having an impervious portion and a previous mesh portion, the impervious portion of each screen being arranged above the previous portion of the screen disposed immediately therebelow.

33. Apparatus according to claim 24, including means for separately weighing each fraction of material, said control means including microprocessor means for calculating the percentage by weight of each fraction of material to the total weight of all fractions of material.

34. A method of analyzing the degradation of leaf tobacco during the processing thereof comprising the steps of:

selecting a sample of tobacco from a tobacco processing line for degradation analysis;

separating the selected sample of tobacco into a plurality of different-sized fractions of tobacco by successively passing the sample over a plurality of screens, each screen having an upper and a lower surface, the overflow of each screen comprising one of said tobacco fractions and the underflow of the last of said screens comprising another tobacco fraction;

sweeping residual tobacco from the screens as overflow by automatically brushing the upper and lower surfaces of at least some of said screens;

electronically weighing each of the fractions of tobacco; and based on the weights of the fractions of tobacco, electronically calculating the percentage by weight of each fraction of tobacco to the total weight of all the tobacco fractions.

35. The method of claim 34, wherein said sweeping step comprises the steps of passing a brush over the lower surface of one screen of an adjacent pair of screens and then passing said brush over the upper surface of the other screen of said pair of screens disposed below said one screen.

36. The method of claim 35, wherein said passing steps comprise passing said brush over an endless path of travel between said adjacent pair of screens.

37. The method of claim 34, wherein said step of selecting a sample of tobacco comprises the steps of:

diverting tobacco from the tobacco processing line;

conveying the diverted tobacco along a first conveyor in a first direction of travel;

discharging the diverted tobacco onto a weigh conveyor, said weigh conveyor having an electronic output indicative of the weight of the tobacco discharged onto the weigh conveyor;

reversing the direction of travel of the first conveyor when the weight of the tobacco on the weigh conveyor reaches a predetermined weight; and conveying the tobacco on the weigh conveyor to the plurality of screens for separation of the sample into fractions.

38. The method of claim 37, including the steps of intermittently supplying tobacco to said weigh conveyor from the tobacco processing line on said first conveyor so as to maintain the weight of tobacco on said weigh conveyor approximately at said predetermined weight.

39. The method of claim 37, including the step of returning the tobacco on the first conveyor to the tobacco processing line until selection of another sample of tobacco is initiated.

40. Apparatus for analysing the degradation of leaf tobacco during the processing thereof comprising:

means for selecting a sample of tobacco from a tobacco processing line for degradation analysis;

means for separating the selected sample of tobacco into a plurality of different-sized fractions of tobacco, said separating means comprising a plurality of screen means over which said sample is passed in succession, said screen means having upper and lower surfaces, each screen means having a respective overflow discharge end for discharging the tobacco fraction associated therewith;

means associated with said separating means for automatically cleaning residual tobacco of the sample from the surfaces of at least some of said screen means; and means for collecting and weighting each of the different-sized fractions of tobacco, said collecting and weighing means comprising a plurality of weigh bucket means for collecting the respective tobacco fractions discharged from the overflow discharge ends of the screen means and for collecting the tobacco fraction discharged as underflow from said plurality of screen means, each weigh bucket means being supported on an electronic weigh scale means for weighing such weigh bucket means and the tobacco fraction contained therein and for producing an output signal indicative of the weight thereon.

41. Apparatus for analyzing the degradation of leaf tobacco during the processing thereof comprising:

means for selecting a sample of tobacco from a tobacco processing line for degradation analysis;

means for separating the selected sample of tobacco into a plurality of different-sized fractions of tobacco, said separating means comprising a plurality of screen means over which said sample is passed in succession, each screen means having upper and lower surfaces, the overflow of each screen means comprising one of said tobacco fractions and the underflow of the last of said screen means comprising another tobacco fraction;

brush means associated with said separating means for automatically sweeping residual tobacco of the sample from the upper and lower surfaces of at least some of said screen means; and means for collecting and electronically weighing each of the different-sized fractions of tobacco whereby the percentage of weight of each fraction of tobacco to the total weight of the tobacco fractions is indicative of the degradation of the tobacco being processed.

42. A method of analyzing the degradation of leaf tobacco comprising the steps of:

selecting a sample of tobacco for degradation analysis;

automatically weighing the sample of tobacco on a weigh conveyor and producing an output signal proportional to the weight of the sample;

moving the weigh conveyor in a first direction to gradually convey the weighed tobacco sample to a separating means;

separating the sample of tobacco into a plurality of fractions; and electronically weighing each fraction of tobacco and producing output signals proportional to the weight of each tobacco fraction.

43. The method of claim 42, including the step of calculating, in response to said output signals, the percentage by weight of each fraction of tobacco to the total weight of the tobacco sample as an indication of the degradation of the tobacco.

44. The method of claim 43, comprising the steps of conveying the tobacco sample from a source of tobacco, discharging the tobacco onto the weigh conveyor and terminating the discharge of tobacco onto the weigh conveyor when a predetermined weight of tobacco is on said weigh conveyor.

45. The method of claim 44, including the step of intermittently discharging additional tobacco onto the weigh conveyor as the weighed tobacco is conveyed by the weigh conveyor to the separating means so as to maintain the weight of tobacco on said weigh conveyor approximately at said predetermined weight.

46. Apparatus for analyzing the degradation of leaf tobacco comprising:

means for selecting a sample of tobacco from a source of tobacco for degradation analysis, said selecting means comprising a weigh conveyor means arranged to receive a supply of tobacco from said source of tobacco for weighing the supplied tobacco nd for producing an output signal proportional to the weight of the sample of tobacco to be analyzed;

means for separating the selected sample of tobacco into a plurality of different-sized fractions of tobacco, said separating means comprising a plurality of screen means over which said sample is passed in succession, said weigh conveyor means being arranged to deliver the selected sample of tobacco to a first one of said screen means;

means for collecting and weighing each of the different-sized fractions of tobacco and for producing output signals indicative of the weights of each tobacco fraction; and means for receiving said output signals and for calculating the percentage by weight of each fraction of tobacco to the total weight of the tobacco sample as an indication of degradation of the tobacco being analyzed.

47. The apparatus of claim 46, including reversible means connected to said weigh conveyor means for driving said weight conveyor means in both directions of travel.

48. The apparatus of claim 47, wherein said weigh conveyor means comprises an endless conveyor supported on force measuring means for measuring the weight of the conveyor and the tobacco sample thereon.

49. The apparatus of claim 47, wherein said means for selecting a sample of tobacco further comprises a second conveyor means for supplying tobacco to the weigh conveyor means from the source of tobacco, second reversible means connected to said second conveyor means for driving said second conveyor means in both directions so as to supply tobacco to the weigh conveyor means in one direction of movement and to return tobacco to the source of tobacco in the other direction of movement.

* * * * *

UNITED STATES PATENT AND TRADEMARK OFFICE

CERTIFICATE OF CORRECTION

PATENT NO. : 4,991,598

DATED : February 12, 1991

INVENTOR(S) : Richard M. Henderson et al

It is certified that error appears in the above-identified patent and that said Letters Patent is hereby corrected as shown below:

Col. 7, line 50, after "particle size" insert --larger than the mesh screen 20b will pass as overflow over--.

Col. 10, line 17, "tee" should be --the--.

In the Claims:

Col. 13, line 8, "mean" should be --means--.

Col. 14, line 55, "previous" should be --pervious--.

Col. 14, line 57, "previous" should be --pervious--.

Col. 15, line 53, "analysing" should be --analyzing--.

Col. 16, line 1, "weighting" should be --weighing--.

Col. 17, line 8, "nd" should be --and--.

UNITED STATES PATENT AND TRADEMARK OFFICE

CERTIFICATE OF CORRECTION

PATENT NO. : 4,991,598

DATED : February 12, 1991

INVENTOR(S) : Richard M. Henderson et al

It is certified that error appears in the above-identified patent and that said Letters Patent is hereby corrected as shown below:

Col. 18, line 6, "weight" should be --weigh--.

Signed and Sealed this

Eighth Day of September, 1992

*Attest:*

DOUGLAS B. COMER

*Attesting Officer*

*Acting Commissioner of Patents and Trademarks*